US005265864A

United States Patent [19]

Roux et al.

[11] Patent Number: 5,265,864

[45] Date of Patent: Nov. 30, 1993

[54] INVERTER WITH A FRICTION/CORRUGATING DRIVER

[75] Inventors: Mary A. Roux; Donald R. Fess, both of Rochester; Gary L. Dent, Sr., Farmington; H. William Gray, Lima, all of N.Y.

[73] Assignee: Xerox Corporation, Stamford, Conn.

[21] Appl. No.: 862,155

[22] Filed: Apr. 2, 1992

[51] Int. Cl.[5] ..... B65H 29/00

[52] U.S. Cl. ..... 271/186; 271/902; 271/188

[58] Field of Search ..... 271/65, 184, 185, 186, 271/272, 291, 902, 188, 209

[56] References Cited

U.S. PATENT DOCUMENTS

| | | | |
|---|---|---|---|
| 3,722,376 | 3/1973 | Wech | 271/270 X |
| 4,214,740 | 7/1980 | Acquaviva | 271/3 |
| 4,269,401 | 5/1981 | Sargis et al. | 271/207 X |
| 4,359,217 | 11/1982 | Rouer et al. | 271/186 |
| 4,589,650 | 5/1986 | Miyoshi | 271/188 X |
| 4,986,529 | 1/1991 | Agarwal et al. | 271/291 |
| 5,082,272 | 1/1992 | Xydias et al. | 271/186 |
| 5,131,649 | 7/1992 | Martin et al. | 271/65 X |

FOREIGN PATENT DOCUMENTS

| | | | |
|---|---|---|---|
| 0047751 | 3/1983 | Japan | 271/902 |
| 0047752 | 3/1983 | Japan | 271/902 |
| 0207247 | 12/1983 | Japan | 271/183 |
| 0185767 | 8/1988 | Japan | 271/902 |
| 0028465 | 1/1990 | Japan | 271/186 |
| 0282160 | 11/1990 | Japan | 271/188 |

*Primary Examiner*—D. Glenn Dayoan

[57] ABSTRACT

A tri-roll inverter for use in machines requiring copy sheet inversion for collated copy set output includes input and output nips. All sheets entering the input nip of the inverter are corrugated by a corrugation system as they enter a spring loaded inversion channel. The corrugation system includes an idler roll, a steel driver roll, and two plastic driver rolls on opposite sides of the steel driver roll. The spring and corrugation system urge the sheets back out of the inversion channel into engagement with the output nip for feeding back into a machine for further processing. The plastic rolls enable each sheet to reach zero velocity quickly and invert at a fast rate without stalling or jamming.

4 Claims, 3 Drawing Sheets

INVERTER WITH A FRICTION/CORRUGATING DRIVER

This invention relates to inverters, and more particularly, to a tri-roll inverter that includes a friction/corrugating driver for driving substrates out of the inverter.

The term copy sheet will be used herein to include all forms of substrates for carrying images, such as, paper, transparencies, etc.

In the field of reprographic machines, it is often necessary to feed along one of two alternate copy sheet paths leaving the processor of the machine, particularly when the machines can selectively produce simplex (one-sided) and duplex (two-sided) copy sheets. Simplex copy sheets may be fed directly to an output tray, whereas when duplex copy sheets are required, the copy sheets may pass to an inverter which automatically reverses the direction of movement of the copy sheets and feeds them back into the processor, but inverted, so that the appropriate data can be applied to the second side of the sheets.

One known inverter for accomplishing the inversion of copy sheets includes three rollers in frictional or geared contact with each other, to provide two spaced-apart nips, one being an input nip to an associated spring surrounded downstream pocket, and the other being an output nip for extracting each sheet from the pocket in cooperation with a corrugating sheet reversing nip. The inverter includes an output baffle at the corrugation nip with raised edges which contributes to corrugation of copy sheets leaving the pocket, but the output baffle also provides unwanted drag to the sheets after they have left the corrugator nip which causes sheets to stall due to insufficient drive force. This stalling of sheets in turn causes jams, as well as, fluctuating inversion times which are unacceptable. This sheet stalling problem is especially noticeable with smooth or low beam strength sheets.

Accordingly, the present invention aims at providing an improved inverter designed to prevent copy sheets from stalling and minimizes the distribution of inversion times for all copy sheet weights and sizes. The improved inverter includes a corrugator member having two plastic rollers mounted on a shaft on either side of a steel drive roller and a sheet contacting raised portions of an output baffle positioned to conform to the copy sheets' natural bend due to corrugation.

The present invention will now be described by way of example with reference to the accompanying drawings, in which.

Figure 1:
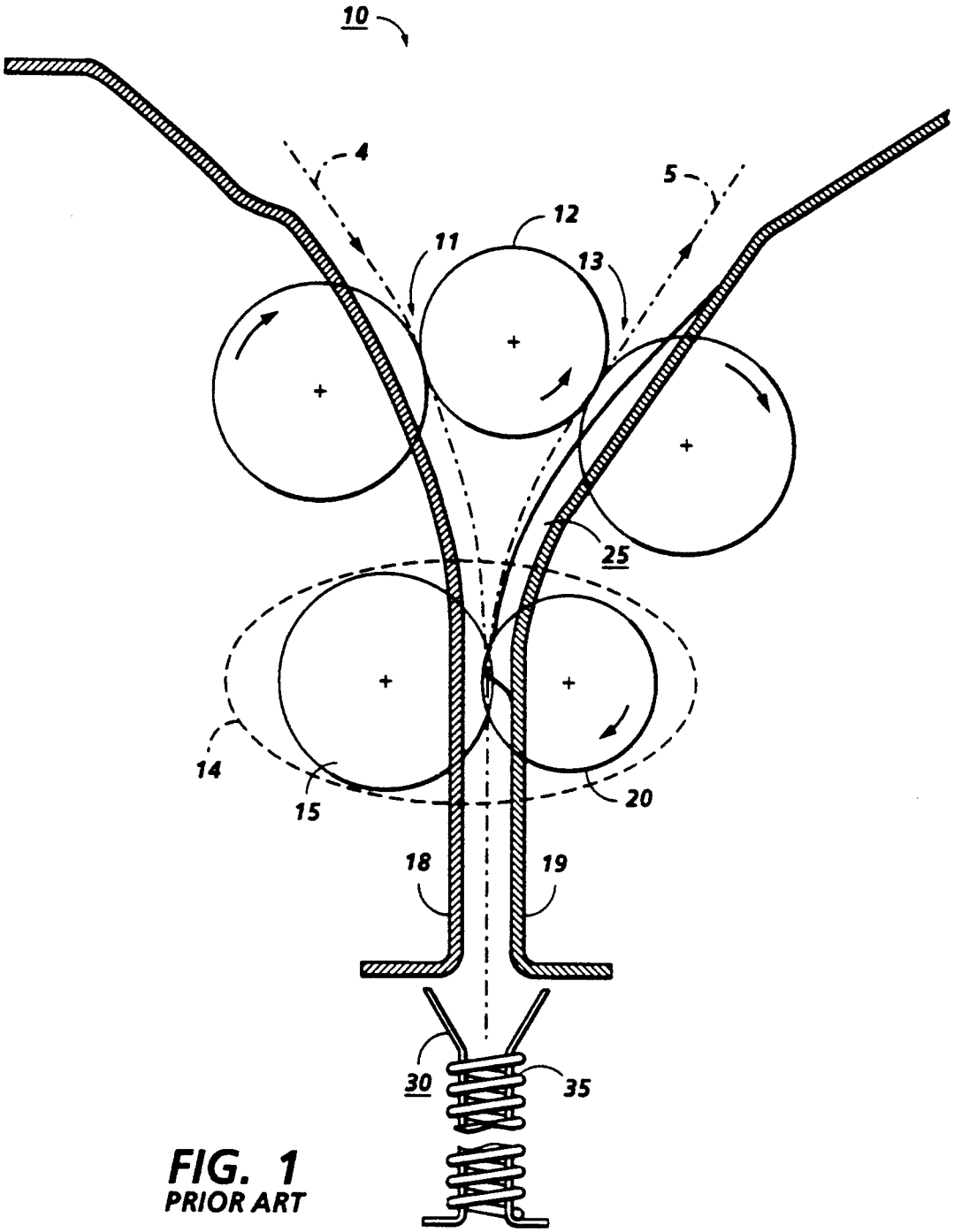
FIG. 1 PRIOR ART
FIG. 1 is a diagrammic side view of a prior art-tri-roll inverter.
Figure 2:
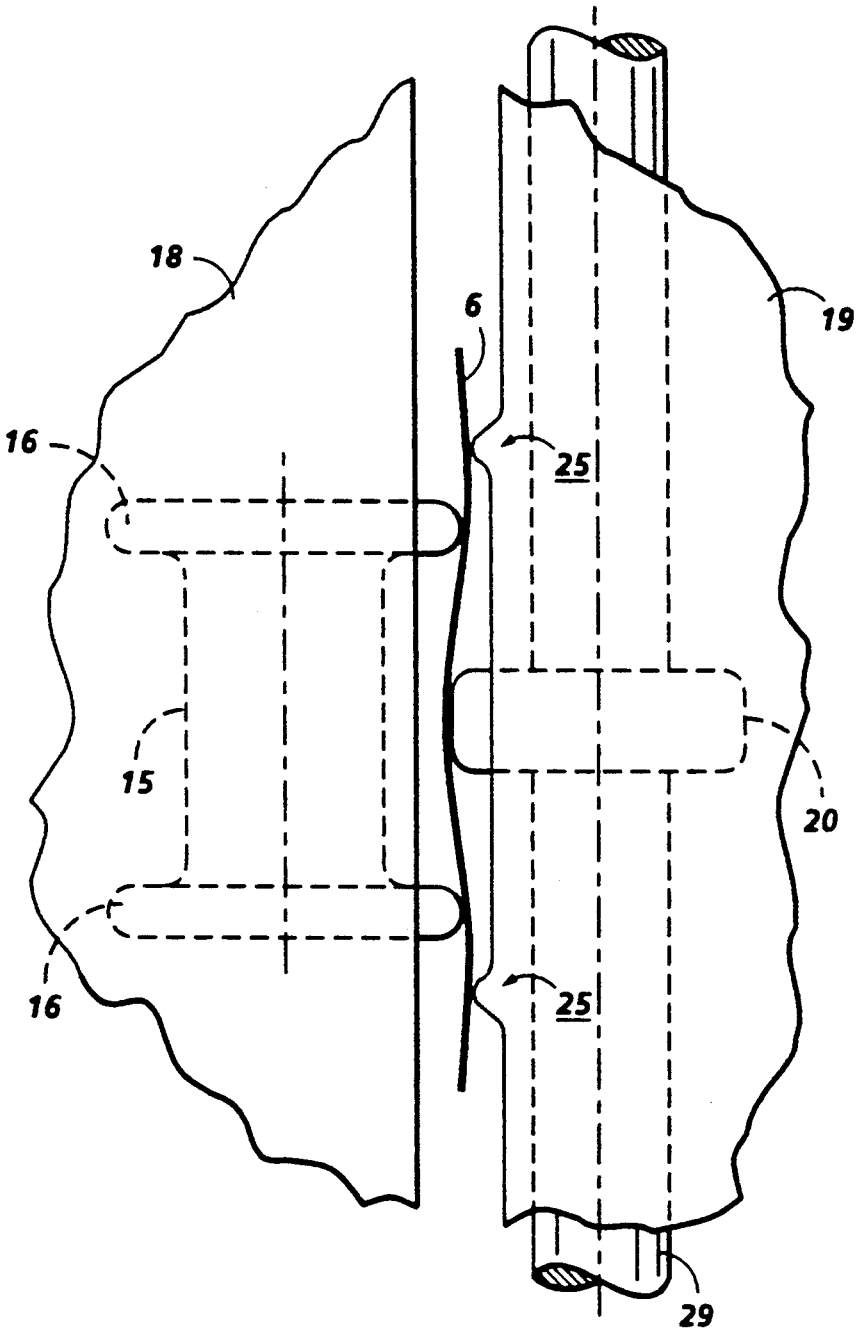
FIG. 2 PRIOR ART
FIG. 2 is a diagrammic partial end view of the prior art tri-roll inverter of FIG. 1 showing the corrugator member and output baffle.

The known tri-roll inverter 10 of FIGS. 1 and 2 which is used, for example, in the Xerox 5100®, includes an input nip formed by rollers 11 and 12 and an output nip formed between rollers 12 and 13. Input and output baffles 18 and 19 guide copy sheets into and out of the inverter. A corrugation system 14 includes a nip formed between rollers 15 and 20 which corrugates copy sheets entering the nip as they are driven by the input nip in the direction of arrow 4 and as the copy sheets are driven out of the inverter in the direction of arrow 5. Corrugation system 14 has an idler roller 15 with edges 16 positioned on opposite sides of steel driver 20. On entry of the lead edge of a copy sheet 6 as shown in FIG. 2, the copy sheet hits the output baffles raised areas 25. These provide unopposed lead in to the corrugator driver 20 of corrugation system. The copy sheet follows the baffle into the corrugator, where there is force applied throughout the remaining length of the copy sheet. This decreases the speed of the copy sheet. When the trail edge of the copy sheet clears the tri-roll input nip, it flips, due to its beam strength, action of the corrugator nip, and roller 12 to become the lead edge for exit from the inverter. As a sheet is driven by the input nip past corrugation system 14 and into a split tubular inversion channel member 30 that is surrounded by a soft linear compression spring 35 that acts as a backstop for each copy sheet as shown in U.S. Pat. No. 4,986,529, which is incorporated herein by reference, the lead edge of each copy sheet stays below the local buckling load. Spring 35 and tube 30 are assembled and arranged such that the tube guides both the spring and the sheets. After a copy sheet leaves the input nip, it is urged back out of the inversion channel by spring 35 and steel driver 20.

Figure 3:
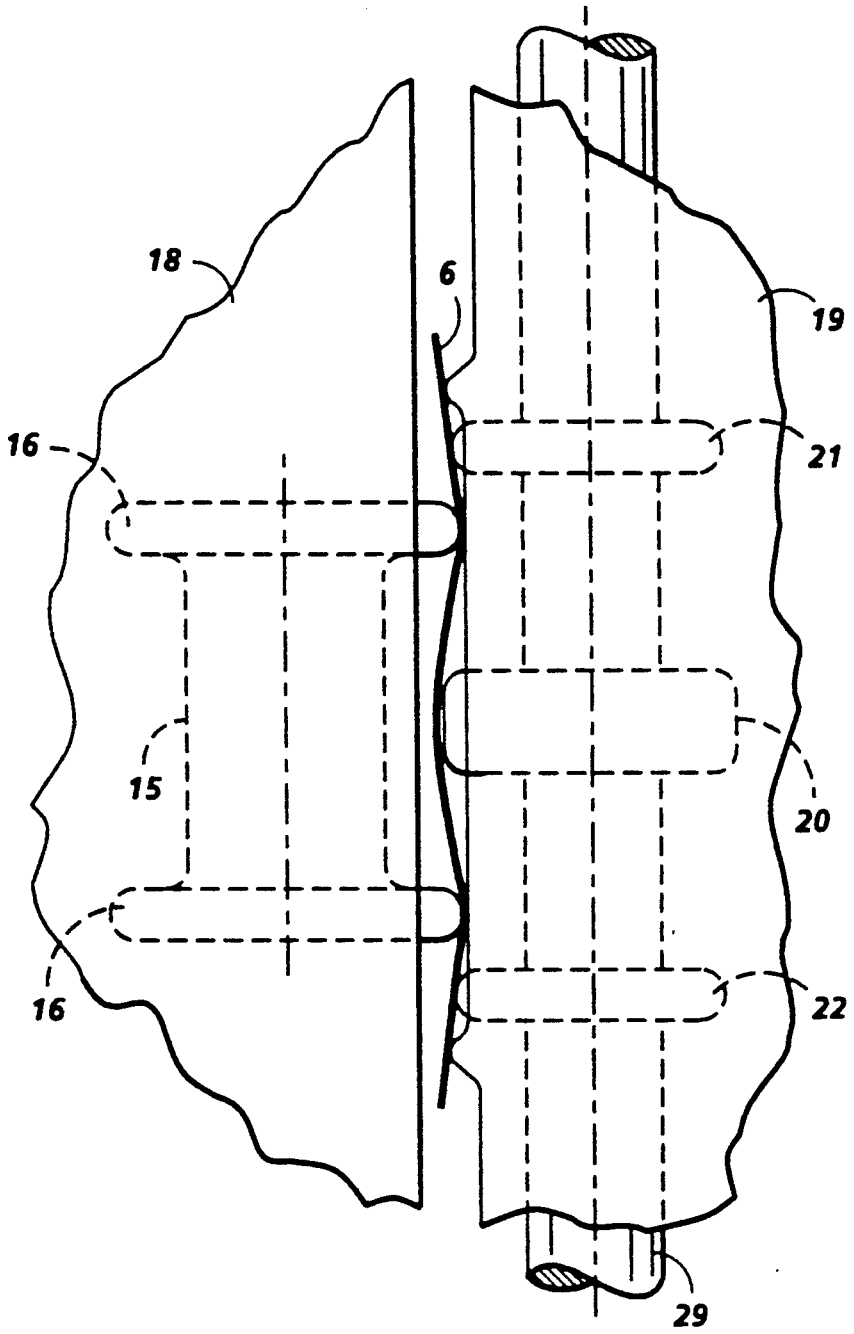
FIG. 3 is a diagrammic partial end view of the improved corrugator member and output baffle of the present invention.

A copy sheet traveling through the inverter relies on spring 35 along with steel driver 20 to absorb its energy and bring the sheet to zero velocity. The steel driver exerts little or no drive force against the sheet and as a result, smooth and light weight copy sheets have been known to stall and cause jams exiting the inverter. Copy sheet portions outside the corrugation idler 15 contacts the raised areas 25 on the baffle which add drag and do not assist in moving the copy sheet. The improvement of the present invention in FIG. 3 overcomes these shortcomings by adding two additional plastic drivers 21 and 22, one on either side of steel driver 20. Copy sheets going through the inverter are corrugated while the plastic rollers apply an additional force against the copy sheet. This enables the copy sheet to reach zero velocity quicker and invert faster. Output baffle 19 has been altered to conform to a copy sheet's natural bend due to corrugation. Stationary raised areas 25 in FIG. 2 on output baffle 19 are replaced with plastic drivers 21 and 22 fixed on drive shaft 29 as shown in FIG. 3. The result is an increase in corrugation of the copy sheet, with the copy sheet portion outside of the corrugator 14 now contacting the plastic driver elements. This produces the necessary drive force on the copy sheet, thereby increasing the drive force over prior inverters for various types of copy sheets and decreases inversion time.

Also, at the point where the trail edge of an incoming sheet clears the tri-roll nip, the additional exit drive force provided by plastic drivers assist the copy sheet up into the tri-roll exit nip (12, 13). This extra drive force is critical in reducing the time the paper spends in the inverter. The friction/corrugator driver always applies a force against the entering sheet, thus the copy sheet does not rely on the inverter springs to absorb all of its energy. The copy sheet reaches zero velocity in a shorter amount of time and is driven out quickly. Having positive contact with the copy sheet at all times provides more reliability than was heretofore possible.

It should now be understood that this tri-roll inverter improvement has been disclosed that prevents copy sheets from stalling and minimizes the distribution of inversion time for all copy sheet weights and sizes by providing a corrugator that includes a steel driver and two plastic drivers on opposite sides of the steel driver. Copy sheets going through the inverter are corrugated while the plastic rollers apply an additional force against the copy sheets. This enables the copy sheets to reach zero velocity quicker and invert faster and thereby solves a problem encountered with copy sheets being only spring propelled out of an inversion chamber into an output nip. Providing positive contact with the sheets at all times with the two plastic rollers also makes the inverter more reliable.

What is claimed is:

1. In an inverter apparatus for handling multiple sized and weights of sheets, including tri-roll input and output nips, a corrugation system, an inversion channel, and a compression spring surrounding the inversion channel, the improvement of the corrugation system characterized by:

an idler roll having a cylindrical center portion with raised edges on opposite ends thereof;

a shaft;

a steel drive roll mounted on said shaft;

a corrugation nip formed between idler roll and said steel drive roll, and wherein said steel drive roll is adapted to drive in a reverse direction from that of said input nip to provide frictional contact with copy sheets driven into said corrugator nip by said input nip; and a pair of plastic drive rolls mounted on said shaft on opposite sides of said steel drive roll to provide additional frictional contact with copy sheets driven into said corrugator nip by said input nip so that the copy sheets will reach zero velocity quickly and be driven out of said corrugator nip without stalling or jamming.

2. The inverter apparatus of claim 1, including input and output baffles, and wherein said output baffle includes raised areas thereon positioned with respect to said corrugator nip for accommodating the natural bend of copy sheets as they are corrugated by said corrugation nip.

3. An inverter apparatus for handling multiple sized and weights of sheets, comprising:

tri-roll means forming input and output nips for driving sheets into and out of the inverter apparatus;

an inversion channel;

a compression spring surrounding said inversion channel;

an idler roll having a cylindrical center portion with raised edges on opposite ends thereof;

a shaft;

a steel drive roll mounted on said shaft;

a corrugation nip formed between said idler roll and said steel drive roll, and wherein said steel drive roll is adapted to drive in a reverse direction from that of said input nip to provide frictional contact with copy sheets driven into said corrugation nip by said input nip; and a pair of plastic drive rolls mounted on said shaft on opposite sides of said steel drive roll to provide additional frictional contact with copy sheets driven into said corrugation nip by said input nip so that the copy sheets will reach zero velocity quickly and be driven out of said corrugation nip without stalling or jamming.

4. An inverter apparatus for handling multiple sized and weights of sheets, comprising:

tri-roll means forming input and output nips for driving sheets into and out of the inverter apparatus;

a corrugation system;

an inversion channel;

a compression spring surrounding said inversion channel;

an idler roll;

a shaft, and wherein said corrugation system includes at least three drive rolls mounted on said shaft to form a corrugation nip with said idler roll and adapted to drive in a reverse direction from that of said input nip to provide frictional contact with copy sheets driven into said corrugation system by said input nip and wherein said at least three drive rolls include a steel drive roll and a pair of plastic drive rolls mounted on said shaft on opposite sides of said steel drive roll to provide additional frictional contact with copy sheets driven into said corrugation system by said input nip so that the copy sheets will reach zero velocity quickly and be driven out of said corrugation system without stalling or jamming.

* * * * *